US007850286B2

(12) United States Patent
Edelen et al.

(10) Patent No.: US 7,850,286 B2
(45) Date of Patent: Dec. 14, 2010

(54) MICRO-FLUID EJECTOR PATTERN FOR IMPROVED PERFORMANCE

(75) Inventors: John Glenn Edelen, Versailles, KY (US); George Keith Parish, Winchester, KY (US); James Harold Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 784 days.

(21) Appl. No.: 11/767,568

(22) Filed: Jun. 25, 2007

(65) Prior Publication Data

US 2008/0316277 A1 Dec. 25, 2008

(51) Int. Cl.
*B41J 2/05* (2006.01)

(52) U.S. Cl. ..... 347/65

(58) Field of Classification Search ..... 347/65, 347/55–59, 61–63, 50, 47, 40, 85, 20, 5, 347/9, 14

See application file for complete search history.

(56) References Cited

U.S. PATENT DOCUMENTS

| | | | | |
|---|---|---|---|---|
| 6,045,214 | A * | 4/2000 | Murthy et al. | 347/47 |
| 2005/0104928 | A1 | 5/2005 | Edelen et al. | |
| 2007/0000863 | A1 | 1/2007 | Bernard et al. | |
| 2007/0070102 | A1 | 3/2007 | Takata | |
| 2007/0076053 | A1 | 4/2007 | Hart et al. | |
| 2007/0085881 | A1 | 4/2007 | Cornell et al. | |

* cited by examiner

*Primary Examiner*—Kristal Feggins

(57) ABSTRACT

A micro-fluid ejection head and method for reducing a stagger pattern distance and improving droplet placement, on a receiving medium. The micro-fluid ejection head includes a substrate containing a plurality of ejection actuators on a device surface thereof and a fluid supply slot for providing fluid to be ejected by the micro-fluid ejection head. The ejection head also includes a flow feature component in flow communication with the fluid supply slot and configured for providing fluid ejection chambers and fluid supply channels for the fluid ejection chambers. Adjacent first and second ejection actuators in a substantially linear array of ejection actuators are each spaced a first distance from the fluid supply slot and second and third ejection actuators in the linear array of ejection actuators are each spaced a second distance from the fluid supply slot that is less than the first distance.

12 Claims, 6 Drawing Sheets

MICRO-FLUID EJECTOR PATTERN FOR IMPROVED PERFORMANCE

FIELD OF THE DISCLOSURE

The present disclosure is generally directed toward micro-fluid ejection heads and to ejector actuator patterns that may improve the performance characteristics of the micro-fluid ejection heads.

BACKGROUND AND SUMMARY

Micro-fluid ejection heads are useful for ejecting a variety of fluids including inks, cooling fluids, pharmaceuticals, lubricants and the like. A widely used micro-fluid ejection head is in an ink jet printer. As the fluid droplet size decreases and speed of fluid ejection increases, factors that effect fluid ejection are magnified requiring solutions to problems that previously did not exist or were too insignificant to be noticed.

Micro-fluid ejection heads may be stationary or, as in the case of many ink jet printers, may advance across a receiving medium in a fluid ejection swath. In order to provide accurate placement of fluid droplets on the medium during movement of the ejection head across a medium, a staggered array of fluid ejectors in a substantially linear array of fluid ejectors may be used. Typically, at least sixteen different distances from a fluid supply slot are used to provide the staggered array of fluid ejectors.

In addition to the staggered array, fluidic interactions between adjacent fluid ejectors may require a staggered firing sequence for the ejectors. Hence, in order to provide a substantially linear placement of fluid droplets on the receiving medium, the firing sequence, the ejector location, and fluidic interactions must be considered. As the speed of droplet ejection increases, there is a need to improve the design and operation of micro-fluid ejection heads to provide rapid firing of ejectors with reduced fluidic interactions and without sacrificing droplet placement accuracies.

In view of the foregoing, exemplary embodiments of the disclosure provide an improved fluid ejector placement pattern and firing sequence that may significantly reduce inaccuracies in droplet placement on a fluid receiving medium as an ejection head travels in an ejection swath across the medium.

In an exemplary embodiment of the disclosure there is provided a micro-fluid ejection head and method for reducing a stagger pattern distance and improving droplet placement on a receiving medium. The micro-fluid ejection head includes a substrate containing a plurality of ejection actuators on a device surface thereof and a fluid supply slot for providing fluid to be ejected by the micro-fluid ejection head. The ejection head also includes a flow feature component in flow communication with the fluid supply slot and configured for providing fluid ejection chambers and fluid supply channels for the fluid ejection chambers. Adjacent first and second ejection actuators in a substantially linear array of ejection actuators are each spaced a first distance from the fluid supply slot and second and third ejection actuators in the linear array of ejection actuators are each spaced a second distance from the fluid supply slot that is less than the first distance.

In another exemplary embodiment of the disclosure there is provided a method for reducing inaccuracies in droplet placement on a fluid receiving medium as an ejection head travels in an ejection swath across the medium. The method includes firing a first ejection actuator in a first firing step, wherein the first ejection actuator is disposed in an adjacent first pair of ejection actuators in a substantially linear column of ejection actuators that are each spaced a first distance from a fluid supply slot. A second ejection actuator is fired in a second firing step, wherein the second ejection actuator is disposed in an adjacent second pair of ejection actuators in the substantially linear column of ejection actuators that are each spaced a second distance from the fluid supply slot. The second ejection, actuator and the first ejection actuator are spaced apart orthogonal to the fluid supply slot by at least a third pair of ejection actuators between the first pair and second pair of ejection actuators in the substantially linear column of ejection actuators.

Yet another exemplary embodiment of the disclosure provides a method for reducing a fluid ejector stagger distance from a fluid supply slot in a substantially linear array of ejection actuators in a micro-fluid ejection head while ejecting fluid droplets onto a receiving medium as the ejection head travels in an ejection swath across the receiving medium. The method includes disposing the ejection actuators in adjacent pairs of ejection actuators to provide pairs of ejection actuators disposed no more than twelve different distances from the fluid supply slot. A first ejection actuator in a first pair of ejection actuators is activated to provide a first fluid droplet on the receiving medium. A second ejection actuator in second pair of ejection actuators is then activated to provide a second fluid droplet on the receiving medium that is substantially aligned with the first fluid droplet. The second pair of ejection actuators is spaced apart from the first pair of ejection actuators along the substantially linear array by at least a third pair of ejection actuators.

An advantage of the exemplary embodiments of the disclosure is that a total stagger distance from a fluid supply slot may be reduced while still providing substantially accurate droplet placement on a fluid receiving medium. Another advantage of the disclosed embodiments is that fluidic interactions between adjacent ejectors may be minimized thereby decreasing the delay time required between firings of adjacent fluid ejectors.

BRIEF DESCRIPTION OF THE DRAWINGS

Further advantages of exemplary embodiments disclosed, herein may become apparent by reference to the detailed description of the embodiments when considered in conjunction with the drawings, which are not to scale, wherein like reference characters designate like or similar elements throughout the several drawings as follows.

DESCRIPTION OF THE EXEMPLARY EMBODIMENTS

According to exemplary embodiments, a heater stagger pattern for a micro-fluid ejection, head is specified that provides a uniquely flexible addressing architecture with a reduced droplet placement error and a reduced maximum ejector distance from a fluid supply slot. The foregoing benefits may be achieved, as described in more detail below, by arranging the fluid ejectors in pairs along a substantially linear array of fluid ejectors, wherein each pair of fluid ejectors has nearly identical spacing from the fluid supply slot. A first member of each pair of fluid ejectors is fired or activated during a first time interval and the second member of the pair of fluid ejectors is fired during a second time interval that may be selected to improve fluid flow to the pair of ejectors.

For the purpose of this disclosure, the term "substantially linear" does not require that the ejectors in an array of ejectors to be exactly the same distance from the fluid supply slot. Accordingly, the ejectors may be spaced so that a maximum difference between an ejector closest to the fluid supply slot and an ejector farthest from the fluid supply slot is no more than about 10 to about 12 microns.

Figure 1:
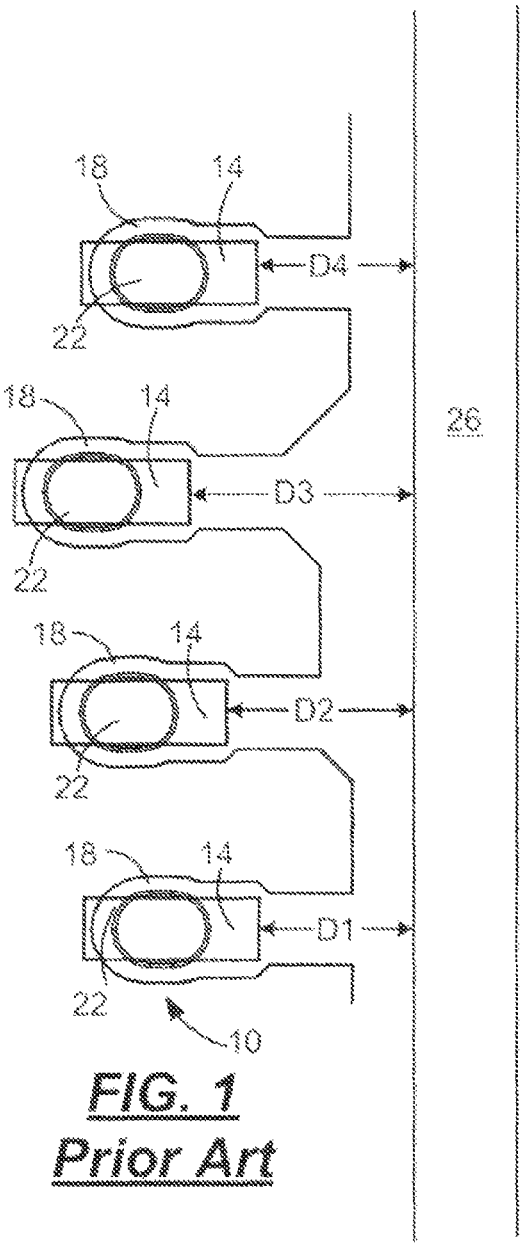
FIG. 1 Prior Art
FIG. 1 is a plan view, not to scale, of a prior art heater and nozzle array layout.
Figure 2:
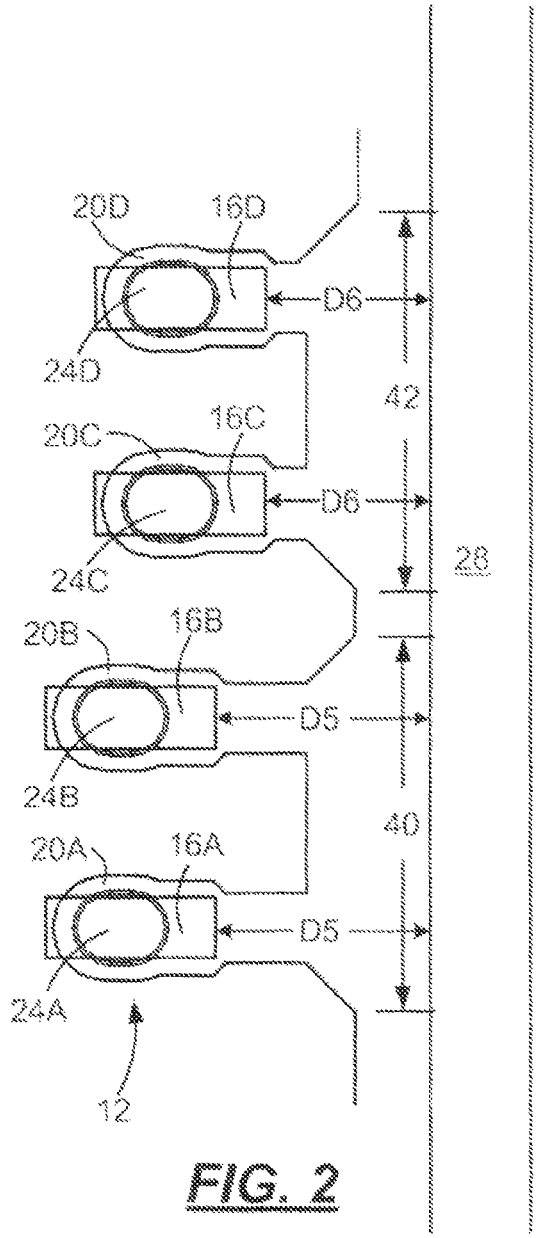
FIG. 2 is a plan view, not to scale, of a heater and nozzle array layout according to an embodiment of the disclosure.

For comparison purposes, a portion of a prior art ejector and nozzle hole array 10 for a prior art micro-fluid ejection head is illustrated in plan view in FIG. 1, and a portion of an ejector and nozzle hole array 12 for a micro-fluid ejection head according to an embodiment of the disclosure is illustrated in plan view in FIG. 2. In FIGS. 1 and 2, the ejector and nozzle arrays 10 and 12 are provided by heaters 14 and 16, respectively that when activated provide a superheated vapor bubble that forces liquid out of fluid chambers 18 and 20, respectively through nozzles 22 and 24, respectively toward a receiving medium. For simplicity, fluid ejectors described herein are referred to as heaters, but are not limited to heaters and may include piezoelectric actuators, electromagnetic actuators, and the like.

As shown in FIG. 1, the heaters 14 are spaced distances D1, D2, D3, and D4 from a fluid supply slot 26. Typically, the heaters 14 are spaced at about sixteen different distances from the fluid supply slot 26 providing a staggered pattern of beaters. By contrast, an ejector and nozzle array 12 according to an embodiment of the disclosure includes a pair of heater/nozzles 16A-16B/24A-24B spaced a first distance D5 from a fluid supply slot 28, and at least a second pair heater/nozzles 16C-16D/24C-24D spaced a second distance D6 from the fluid supply slot 28. In an array of neater/nozzles 16/24 according to one embodiment of the disclosure, the pairs of heater/nozzles 16/24 are spaced no more than twelve different distances from the fluid supply slot 28. In another embodiment of the disclosure, the pairs of heater/nozzles 16/24 are spaced no more than ten different distances from the fluid supply slot 28. In yet another embodiment of the disclosure, the pairs of heater/nozzles 16/24 are spaced no more than eight different distances from the fluid supply slot 28. Accordingly, a maximum distance from the fluid supply slot 28 of the heater/nozzle pairs 16/24 in FIG. 2 according to the disclosure is about half of the maximum distance from the fluid supply slot 26 of the heater/nozzles 14/22 in array 10 of FIG. 1.

Figure 3:
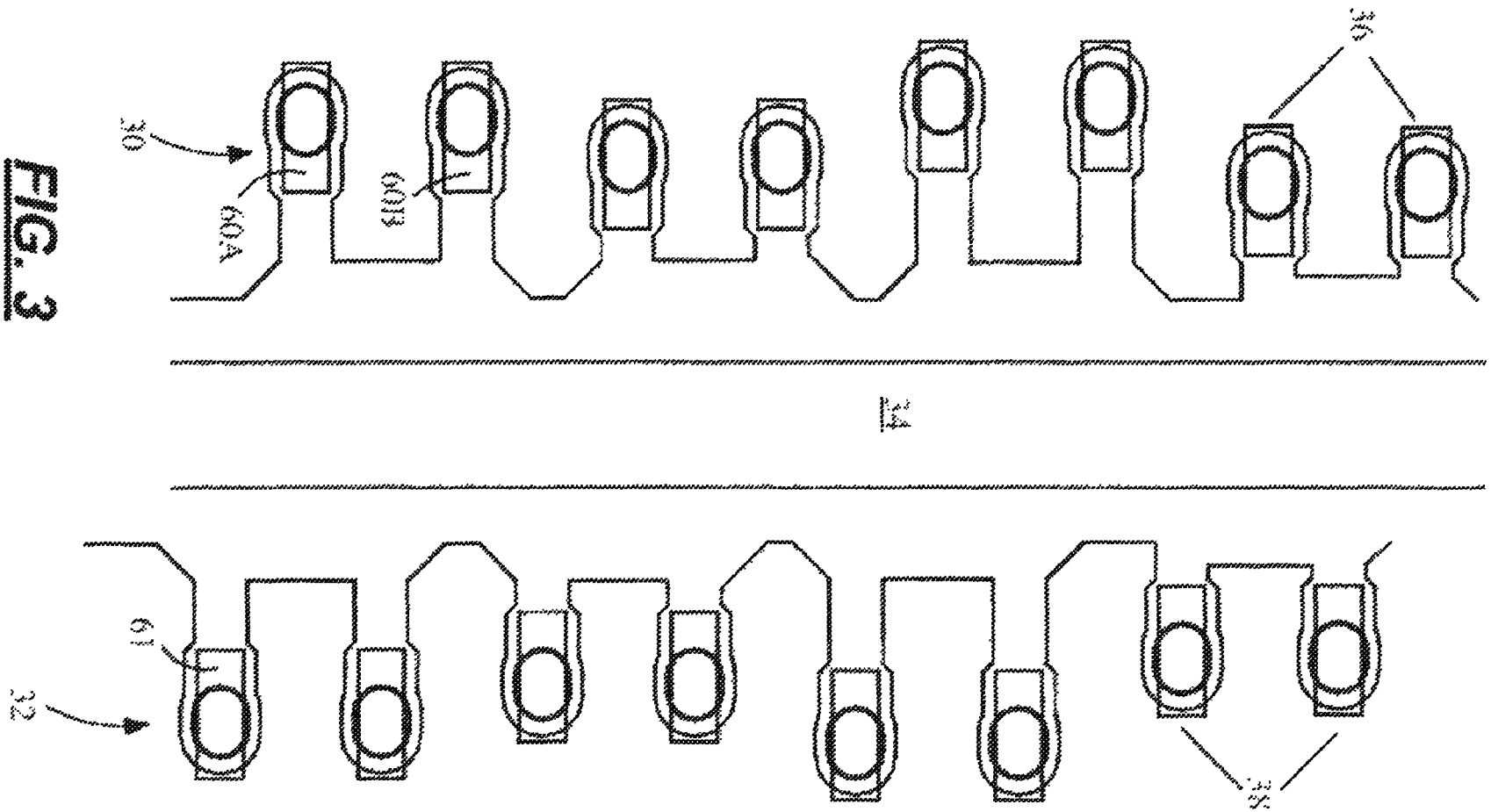
FIG. 3 is a plan view, not to scale, of a heater and nozzle array layout according to another embodiment of the disclosure.

It will be appreciated that the heater/nozzles 16/24 may be disposed only on one side of the fluid supply slot 28 or on both sides of the fluid supply slot 28 where heater/nozzles 16/24 on an opposing side of the slot 28 are offset from the heater/nozzles 16/24 in array 12. FIG. 3 illustrates nozzle and heater arrays 30 and 32 disposed on both sides of a fluid supply slot 34, wherein heater/nozzle pairs, such as pairs 36 are shifted or offset from heater/nozzle pairs, such as pairs 38 on an opposite side of the fluid supply slot. Advantages of the nozzle and heater arrays 20 and 32 of FIG. 3 are described in more detail below.

Another feature of the heater/nozzle array 12 according to the disclosure is a use of a common or shared entry channels 40 and 42 (FIG. 2) for each pair of heater/nozzles 16/24 in the array 12. For example, entry channel 40 is associated with chambers 20A and 20B and entry channel 42 is associated with chambers 20C and 20D. The shared entry channels 40 and 42 essentially double the width of each entry channel to heater pairs 16A/16B spaced further from the fluid supply slot 28 than heater pairs 16C/16D, thereby reducing the influence of increased distance D5 on chambers 20A and 20B fluid refill times. Accordingly, since the heaters 16C and 16D are closer to the fluid supply slot 28 than heaters 16A and 16B, the entry channel 42 may be narrower or smaller than the entry channel 40. By balancing the entry channel 40 and 42 dimensions with the distances D5 and D6 of the heaters 16A-16D from the fluid supply slot 28, a reduced variation in fluid ejection velocity may result, which in turn may reduce droplet placement errors on the receiving medium.

Another factor that influences droplet placement accuracy is the relative position of the ejectors (i.e., stagger pattern) with respect to the fluid supply slots as the ejection bead moves across a receiving medium. The stagger pattern of the ejectors is constrained by a desired spacing between fluid droplets on the fluid droplet receiving medium as the ejection head moves across the medium. It is also desirable that sequentially fired ejectors be spatially separated from one another to enable sufficient fluid refill times between firings and so that fluidic interference from an adjacent ejector are minimized. Accordingly, the heaters 14 or 16 in arrays 10 or 12 (FIGS. 1 and 2) are typically not fired in their natural spatial order; rather, the heater firing order is selected to maximize a time between firings of adjacent and nearby heaters 14 and 16.

Figure 4:
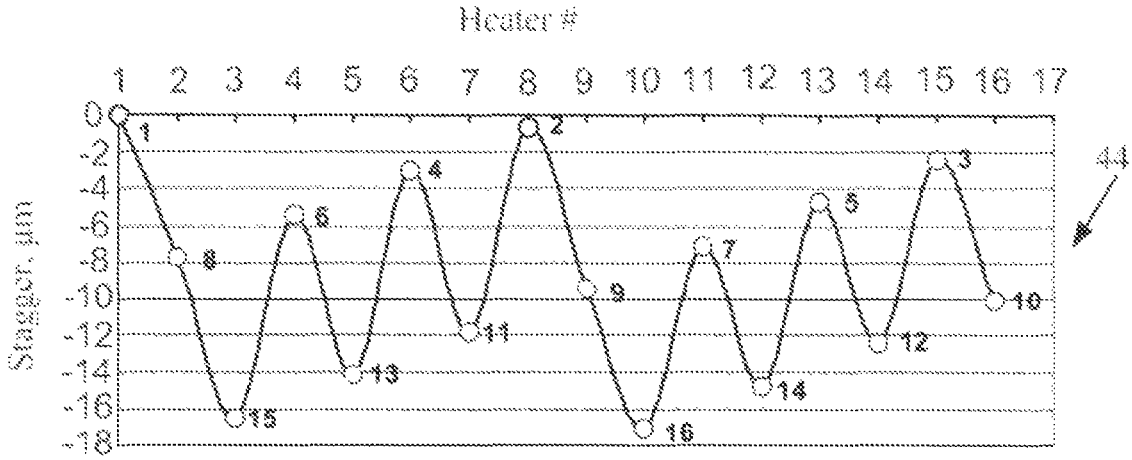
FIG. 4 Prior Art
FIG. 4 is a prior art stagger array firing sequence.

The selected heater firing order determines a repeating pattern of heater locations hereinafter referred to as "a primitive group" of heaters. The number of heaters in the primitive group is set by the total number of heaters to be fired and a required address window time. An example of a typical stagger pattern 44 for heaters according to the prior art heater/nozzle array is shown in FIG. 4. As shown in FIG. 4, each primitive group of heaters contains sixteen heaters. The heaters in each primitive group are numbered from left to right across the top of the stagger pattern 44. The stagger distance between heaters from the closest, heater to the fluid supply slot 26 to the heater farthest from the fluid supply slot 26 is given along the vertical axis on the left side of the stagger pattern 44, with the closest heater to the slot 26 having a stagger distance of zero microns. The circles in the stagger pattern 44 represent the firing order for the heaters. For example, the first heater to fire is heater number 1 and the second heater to fire is heater number 8. Heater number 8 is slightly farther from the fluid supply slot 26 than heater number 1. The third heater to fire is heater number 15, and so on until all sixteen heaters in the primitive group of heaters has fired. As shown, each of the heaters is spaced a different distance from the fluid supply slot 26 as discussed above.

Accordingly, the stagger distance between heaters ranges from 0 microns to a maximum stagger distance of about 18 microns. It will be appreciated that heater 16 positioned about 18 microns further from the fluid supply slot 26 will require a longer time for fluid to refill the fluid chamber 18 than all of the other heaters that are positioned closer to the fluid supply slot 26. The foregoing prior art configuration therefore reduces the speed with which heaters can be fired in rapid succession.

Figure 5:
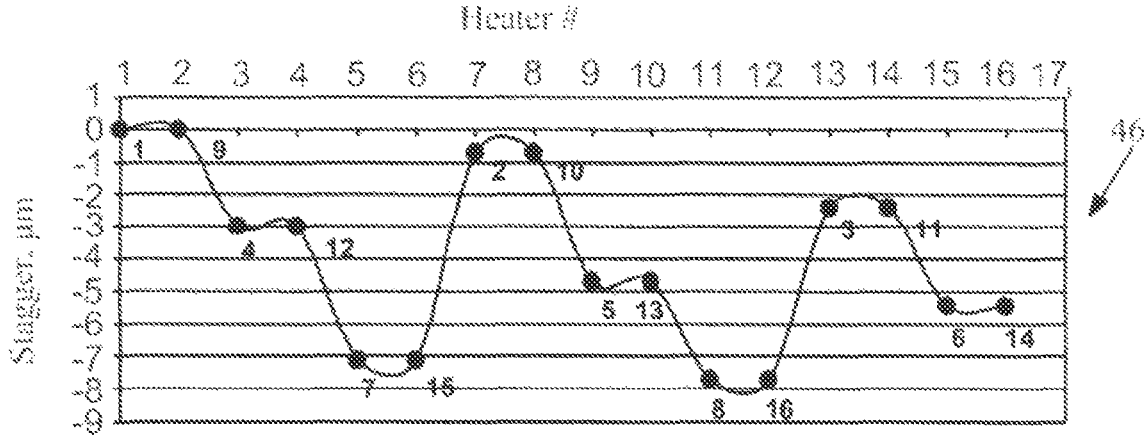
FIG. 5 is a stagger array firing sequence according to an embodiment of the disclosure.

It is desirable, from a perspective of fluid delivery to the fluid chambers 18 to minimize the stagger distance in order to decrease delay times for firing individual, heaters. The embodiment, disclosed in FIGS. 2 and 3 provides a stagger pattern as shown in FIG. 5 having a maximum stagger distance that is about half of the maximum stagger distance provided by the prior art heater/nozzle array 10 of FIG. 1. In the stagger pattern illustrated in FIG. 5 all sixteen heaters in the primitive group are spaced apart no snore than about 10 microns from the closest heaters to the heaters farthest from the fluid supply slot 28. Accordingly, the heaters closest to the fluid supply slot 28 may be spaced from about 30 to about 40 microns from the fluid supply slot 28 and the heaters farthest from the fluid supply slot 28 may be spaced from about 40 to about 55 microns from the fluid supply slot 28.

As in FIG. 4, the first heater to fire is heater number 1, however the second heater to fire, according to stagger pattern 46, is heater number 7. Using the stagger pattern 46 of FIG. 5, a first half of the heaters in the primitive group are fired in the first 10.6 microns movement of the ejection head and a second half of the heaters in the primitive group are fired in the next 10.6 microns movement of the ejection head. The foregoing design of FIGS. 2 and 3 provides a benefit that reduces the stagger distance by half compared to the prior art design of FIG. 1. The stagger pattern 46 has an additional benefit that pairs of heaters may share the same fluid entry channel 40 or 42 as described above.

Figure 6:
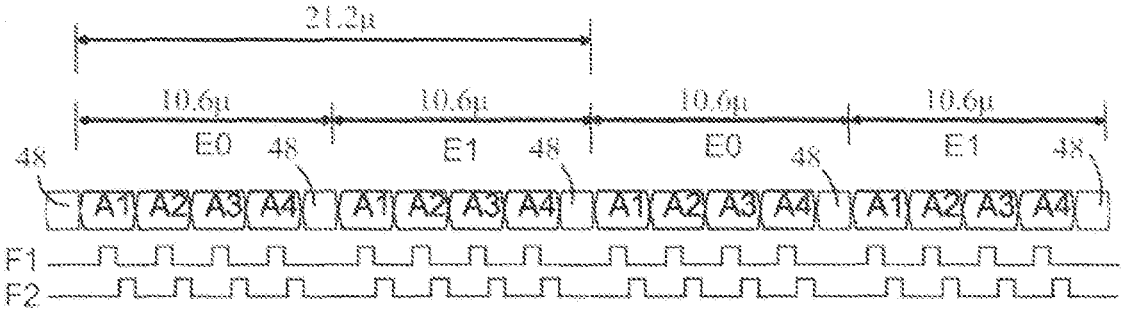
FIG. 6 is a schematic view of an address and firing sequence according to an embodiment of the disclosure.

The heaters 16 in each primitive group of heaters 16 may be addressed and fired as shown in FIG. 6. Using stagger pattern 46 illustrated in FIG. 5, heater addresses A1-A4 are divided into two extended address regions E0 and E1. A first extended address region E0 addresses eight heaters in the first 10.6 micron movement of the ejection head, followed by a dead time half cycle 48. The pattern then repeats for the E1 addressed heaters 16 in the next 10.6 micron movement of the ejection head. The result is a pattern 50 of droplets 52 with a 10.6 micron horizontal spacing between droplets 52 as illustrated in FIG. 7.

Figure 7:
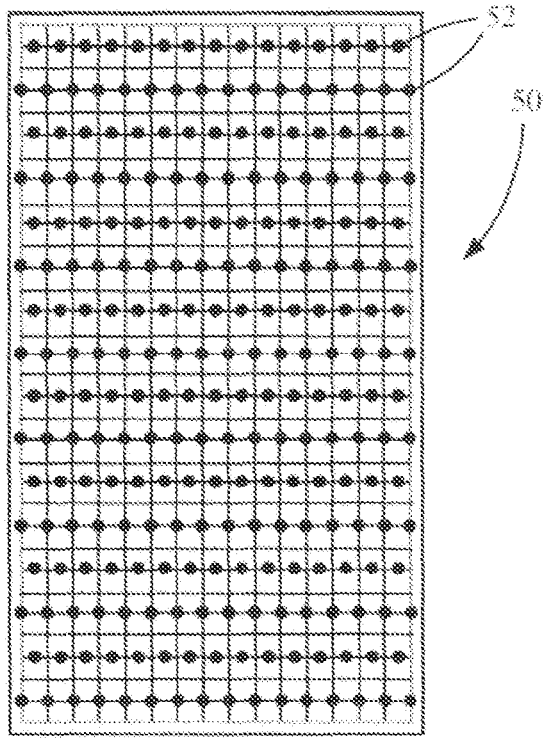
FIG. 7 is a checkerboard droplet pattern produced by a staggered array firing sequence according to the disclosure.

With reference to FIG. 7, if ail fluid droplets were elected at a uniform velocity, droplets ejected from a micro-fluid ejection head with the stagger pattern 46 ought not fall on a true 21.2 micron grid, but on a 10.6 micron horizontal checkerboard pattern. In reality, there is considerable variation both in droplet velocity and in the characteristics of droplet breakup. Advantages related to fluid delivery that adhere to the disclosed embodiments outweigh any inherent (theoretical) droplet misplacement on a receiving medium. In fact, fluid droplets deposited on a medium using the stagger pattern 46 may actually be deposited closer to their intended placements and with less variation than fluid droplets ejected from the prior art stagger pattern 44.

Figure 8:
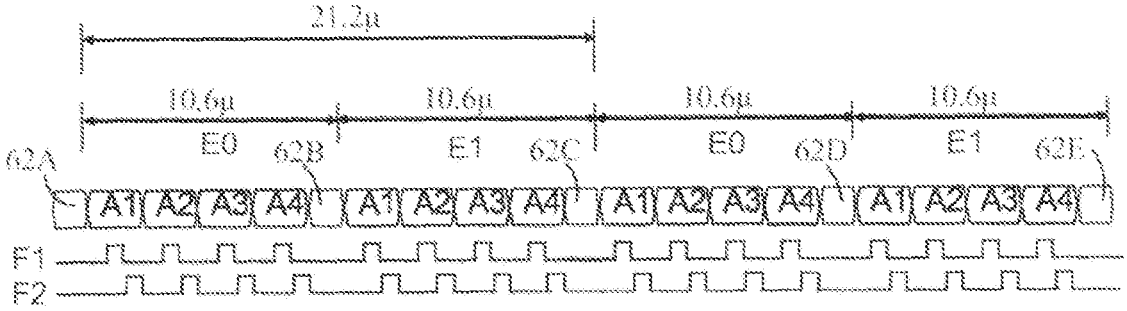
FIG. 8 is a schematic view of an address and firing sequence according to a second embodiment of the disclosure.
Figure 9:
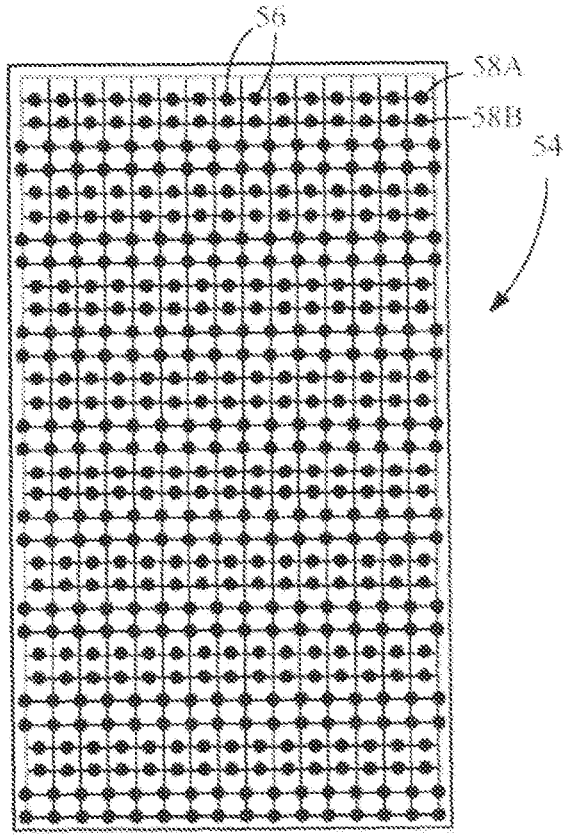
FIG. 9 is a checkerboard droplet pattern produced by a staggered array firing sequence according to the second embodiment of the disclosure.

With reference to FIGS. 8 and 9, the nozzle and heater arrays 30 and 32 of FIG. 3 may be addressed according to the address sequence of FIG. 8 to produce a pattern 54 of droplets 56 as illustrated in FIG. 9 that are spaced apart horizontally as described with reference to FIG. 7 and droplets 58A and 58B that are spaced apart from one another 10.6 microns in vertical direction. Droplet 58A is generated by a heater 60 on a first side of the slot 34 and droplet 58B is generated by a heater 61 on an opposite side of the slot 34 from heater 60.

In address cycle A1, two heaters 60 are fired providing droplets 58A. A similar address and fire sequence as in FIG. 8 is provided for heaters 61 on an opposite side of the slot from heaters 60, providing droplets 58B. The same patterns are repeated for each of the address sequences A1 to A4 until all heaters have been fired providing the pattern 54, referred to herein as a "couplet pattern."

As with the address sequence illustrated in FIG. 6, the address sequence of FIG. 8 also includes dead time half address cycles 62A-62E in each of the extended address regions E0 and E1. The dead time half address cycles 62A-62E provide an ability to more accurately place droplets 56 on a receiving medium. There is at least one dead time half address cycle, such as cycle 62C between the firing of the first heater 60A of a pair of heaters 60A and 60B and the firing of the second heater 60B of the pair of heaters 60A and 60B as generally illustrated in FIG. 5 by the firing sequence of heaters 1 and 2. Accordingly, each substantially linear array of nozzles and heaters 30 and 32 on opposites sides of the slot 34 includes such half address cycle dead times 62A-62C.

In the first extended address region E0, eight heaters 60 on one side of the slot 34 are fired in the first 10.6 micron movement of the ejection head, followed by the half address cycle dead time 62B. The pattern then repeats for the E1 addressing of eight heaters 60 in the next 10.6 micron movement of the ejection head until all of the heaters 60 in nozzle and heater array 30 (FIG. 3) have been fired at least once. Heaters 61 on an opposite side of the slot 34 are addressed with a similar firing pattern to provide the couplet pattern 54 as described above. It will be appreciated that the pattern 54 may be produced according to the disclosure with greater accuracy and improved fluid flow characteristics as a result of the firing sequence and reduction in maximum distance of the heaters 60 and 61 from the slot 34 compared to prior art heater stagger arrays and firing sequences.

Figure 10:
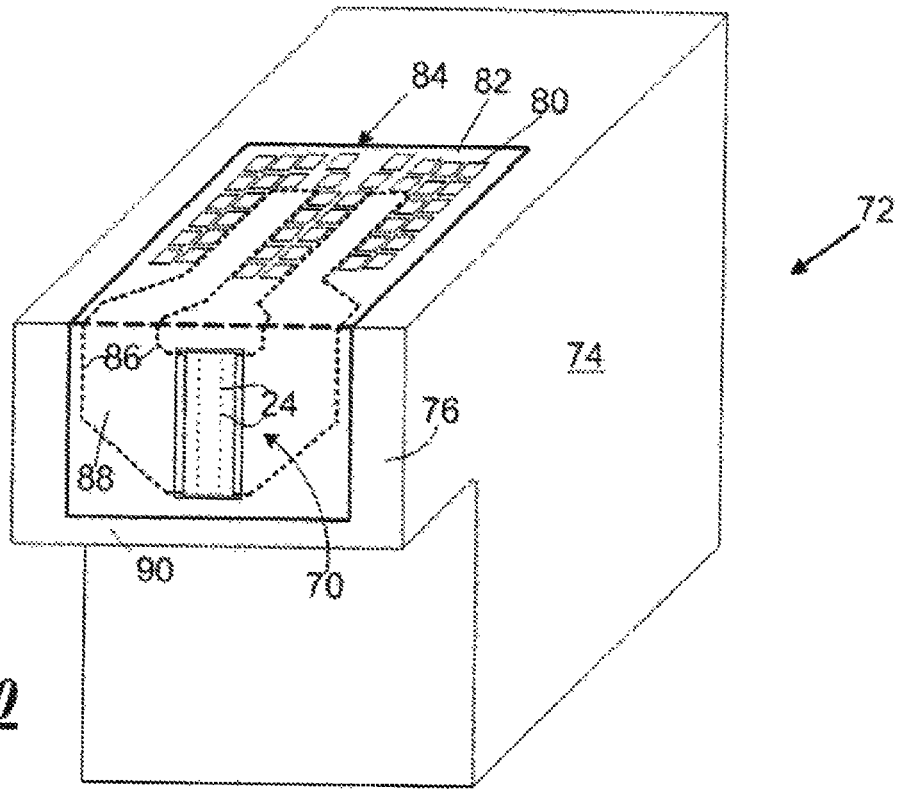
FIG. 10 is a perspective view, not to scale, of a fluid cartridge body and ejection head according to the disclosure.

Ejection heads 70 according to the foregoing disclosed embodiments may be used with integral fluid supply reservoirs 72 as illustrated in FIG. 10, or with fluid supply reservoirs remote from the ejection head. The fluid supply reservoir 72 includes a body portion 74 and an ejection head portion 76 for feeding fluid to the micro-fluid ejection head 70 for ejection of fluid toward the receiving medium from nozzles 24. Each reservoir 72 may contain a single fluid, such as a black, cyan, magenta or yellow ink or may contain multiple different fluids. In the illustration shown in FIG. 10, the reservoir 72 has a single micro-fluid ejection head 70 for ejecting a single fluid. However, the reservoir 72 may contain two or more ejection heads for ejecting two or more fluids, or a single ejection head may eject multiple fluids, or other variations on the same.

Figure 11:
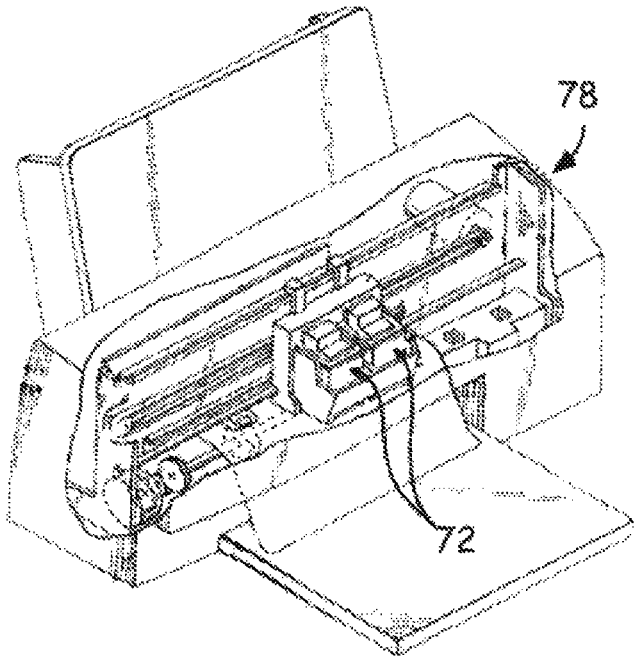
FIG. 11 is a perspective view, not to scale, of an ink jet printer containing a fluid cartridge and ejection head according to the disclosure.

In order to control the ejection of fluid from the nozzles 24, each of the micro-fluid ejection beads 70 is usually electrically connected to a controller in an ejection control device, such as, for example, a printer 78 (FIG. 11), to which the reservoir 72 is attached. In the illustrated embodiment, connections between the controller and the reservoir 72 are provided by contact pads 80 which are disposed on a first portion 82 of a flexible circuit 84. An exemplary flexible circuit 84 is formed from a resilient polymeric film, such as a polyimide film, which has conductive traces 86 thereon for conducting electrical signals from a source to the ejection head 70 connected to the traces 86. A second portion 88 of the flexible circuit 84 is typically disposed on an operative side 90 of the head portion 76. The reverse side of the flexible circuit 84 typically contains the traces 86 which provide electrical continuity between the contact pads 80 and the micro-fluid ejection head 70 for controlling the ejection of fluid from the micro-fluid ejection heads 70. TAB bond or wire bond connections, for example, are made between the traces 86 and the micro-fluid ejection head 70.

It is contemplated, and will be apparent to those skilled in the art from the preceding description and the accompanying drawings that modifications and/or changes may be made in the embodiments disclosed herein. Accordingly, it is expressly intended that the foregoing description and the accompanying drawings are illustrative of exemplary embodiments only, not limiting thereto, and that the true spirit and scope of the disclosed embodiments be determined by reference to the appended claims.

What is claimed is:

1. A micro-fluid ejection head, comprising:

a substrate containing a plurality of ejection actuators on a device surface thereof and a fluid supply slot for providing fluid to be ejected by the micro-fluid ejection head; and a flow feature component in flow communication with the fluid supply slot and configured for providing fluid ejection chambers and fluid supply channels for the fluid ejection chambers, wherein adjacent first and second ejection actuators in a substantially linear array of ejection actuators are each spaced a first distance from the fluid supply slot and second and third ejection actuators in the linear array of ejection actuators are each spaced a second distance from the fluid supply slot that is less than the first distance.

2. The micro-fluid ejection head of claim 1, wherein the first and second ejection actuators share a common fluid entry channel for flow of fluid to respective first and second fluid supply channels for the first and second ejection actuators.

3. The micro-fluid ejection head of claim 1, wherein the plurality of ejection actuators are activated in an ejection sequence that provides fluid droplet spacing along a first axis of about 10.5 microns and fluid droplet spacing along a second axis orthogonal to the first axis of about 21 microns.

4. The micro-fluid ejection head of claim 1, wherein spatially separated ejection actuators are activated sequentially.

5. The micro-fluid ejection head of claim 1, wherein the substantially linear array of fluid ejection actuators comprises pairs of fluid ejection actuators that are spaced from the fluid supply slot in no more than twelve different distances from the fluid supply slot.

6. The micro-fluid ejection head of claim 5, wherein a maximum distance between a pair of fluid ejection actuators closest to the fluid supply slot and a pair of fluid ejection actuators farthest from the fluid supply slot ranges from about six to about ten microns.

7. A method for reducing inaccuracies in droplet placement on a fluid receiving medium as an ejection head travels in an ejection swath across the medium, the method comprising the steps of:

firing a first ejection actuator in a first firing step, wherein the first ejection actuator is disposed in an adjacent first pair of ejection actuators in a first substantially linear column of ejection actuators that are each spaced a first distance from a fluid supply slot;

firing a second ejection actuator in a second firing step, wherein the second ejection actuator is disposed in an adjacent second pair of ejection actuators in the first substantially linear column of ejection actuators that are each spaced a second distance from the fluid supply slot;

wherein the second ejection actuator and the first ejection actuator are spaced apart orthogonal to the fluid supply slot by at least one pair of ejection actuators between the first pair and second pair of ejection actuators in the first substantially linear column of ejection actuators.

8. The method of claim 7, wherein the second ejection actuator and the first ejection actuator are spaced apart orthogonal to the fluid supply slot by at least two pairs of ejection actuators between the first pair and second pair of ejection actuators in the substantially linear column of ejection actuators.

9. The method of claim 7, wherein the substantially linear column of ejection actuators is comprised of ejection actuators disposed no more than eight different distances from the fluid supply slot in pairs of ejection actuators.

10. The method of claim 7, wherein a maximum distance between a pair of fluid ejection actuators closest to the fluid supply slot and a pair of fluid ejection actuators farthest from the fluid supply slot ranges from about six to about ten microns.

11. The method of claim 7, further comprising:

firing a third ejection actuator in the first firing step, wherein the third ejection actuator is disposed in an adjacent third pair of ejection actuators in a second substantially linear column of ejection actuators that are each spaced a third distance from the fluid supply slot, wherein the second substantially linear column of ejection actuators is disposed on an opposite side of the fluid supply slot from the first substantially linear column of ejection actuators;

firing a fourth ejection actuator in the second firing step, wherein the fourth ejection actuator is disposed in an adjacent fourth pair of ejection actuators in the second substantially linear column of ejection actuators that are each spaced a fourth distance from the fluid supply slot;

wherein the fourth ejection actuator and the third ejection actuator are spaced apart orthogonal to the fluid supply slot by at least one pair of ejection actuators between the third pair and fourth pair of ejection actuators in the second substantially linear column of ejection actuators.

12. The method of claim 11, wherein an address sequence for firing the ejection actuators comprises at least one half cycle dead time between address sequences for the ejection actuators in each pair of ejection actuators in each substantially linear column of ejection actuators.

* * * * *